United States Patent [19]

Wiley

[11] Patent Number: 5,051,655

[45] Date of Patent: Sep. 24, 1991

[54] ELECTRODES FOR SINGLE ENDED ARC DISCHARGE TUBES

[75] Inventor: Emmett H. Wiley, Chesterland, Ohio

[73] Assignee: Venture Lighting International, Inc., Solon, Ohio

[21] Appl. No.: 7,618

[22] Filed: Jan. 28, 1987

[51] Int. Cl.[5] ..... H01J 61/04

[52] U.S. Cl. ..... 313/631; 313/621

[58] Field of Search ..... 313/631, 620, 621, 622, 313/623, 634, 619, 331, 332, 318

[56] References Cited

U.S. PATENT DOCUMENTS

| | | | |
|---|---|---|---|
| 1,632,578 | 6/1927 | Bahr | 313/631 X |
| 2,945,977 | 7/1960 | Schonherr | 313/621 X |
| 4,308,483 | 12/1981 | Keeffe et al. | 313/620 |
| 4,320,322 | 3/1982 | Rothwell, Jr. et al. | 313/621 |
| 4,321,504 | 3/1983 | Keeffe et al. | 313/620 |
| 4,415,829 | 11/1983 | Rothwell, Jr. et al. | 313/621 |
| 4,454,450 | 6/1984 | English et al. | 313/620 |

*Primary Examiner*—Donald J. Yusko
*Assistant Examiner*—Michael Horabik
*Attorney, Agent, or Firm*—Rogers & Killeen

[57] ABSTRACT

Electrodes for a single ended arc discharge tube in which the electrodes diverging from the foil leads are generally concave towards each other between the lead-in wire ribbons and the free ends thereof from which the arc is drawn, the electrodes being spaced apart a greater distance at the point of entering the envelope than the distance between the ribbons.

11 Claims, 1 Drawing Sheet

ELECTRODES FOR SINGLE ENDED ARC DISCHARGE TUBES

BACKGROUND OF THE INVENTION

The present invention relates to the electrodes of a single ended arc discharge tube. Such tubes are typically used in conjunction with a reflector for low wattage task lighting applications and for high wattage stage/studio lighting applications.

In single ended arc discharge tubes, it is desirable that the arc occur at the extreme free ends of the electrodes and in the center of the envelope of the arc tube. Conventional designs include the linear electrodes disclosed for example in the Keeffe, et al., U.S. Pat. No. 4,321,504 dated Mar. 23, 1982 and in FIG. 1 of the appended drawings. Electrode breakdown deposits tend to accumulate at the coolest spot in the bulb, generally the point where the electrodes emerge from the pinch seal forming a conductive layer, and thus tend to reduce the distance between the electrodes and cause arcing at points other than the free ends. The location of the arc near the pinch seal not only moves the arc from the desired location in the center of the arc tube envelope, but results in rapid deterioration and failure of the lamp.

In an attempt to avoid the "Jacobs Ladder" effect of one or more arcs intermediate the length of the electrodes, the prior art has reduced the spacing between the free ends of the electrodes related to the spacing of the electrodes elsewhere within the arc tube envelope. The electrodes may be curved towards each other such as illustrated in the Rothwell, Jr., et al., U.S. Pat. No. 4,415,829 dated Nov. 15, 1983 and shown in FIG. 2 of the drawing appended hereto. In other prior art designs, the electrodes may be angled towards each other as shown in the Keeffe, et al., U.S. Pat. No. 4,308,483 dated Dec. 29, 1981 and illustrated in FIG. 3 in the drawing appended hereto. In still other prior art designs, one of the electrodes may be angled and the other curved to provide a generally axial arc. By way of example, such electrode structure is shown in the English, et al., U.S. Pat. No. 4,454,450 dated June 12, 1984 and is illustrated in FIG. 4 of the drawing appended to this application.

The attempts of the prior art to deal with this undesirable arcing problem have not been entirely successful. The spacing between the ribbons or foils which connect the lead-in wires to the electrodes is generally limited by the pinch seal, and is typically well inside the inside walls of the arc tube envelope. This spacing has dictated the maximum spacing of the electrodes at the point where they exit the pinch seal and enter the envelope of the arc tube. The inclination of the electrodes towards each other from that point tends to reduce the undesirable arcing problem short of the extreme free ends, but has not been fully effective because of the limited spacing available at the egress of the electrodes from the pinch seal. To increase the space between the electrodes, it is known in some lamps to increase the width of the pinch. However, such an increase in width often affects undesirably other operating characteristics of the lamp.

It is accordingly an object of the present invention to obviate such problems and to provide a novel single ended arc discharge tube.

Another object of the present invention is to provide a single ended arc discharge tube in which the electrodes enter the envelope of the tube at a spacing greater than that of the ribbons connecting the electrodes to the lead-in wires.

Still another object of the present invention is to provide a novel single ended arc discharge tube in which the electrodes are generally concave towards each other between the ribbons and the free ends thereof.

Another object of the present invention is to provide a novel single ended arc discharge tube in which the electrodes diverge within the pinch seal of the arc tube.

These and other objects and advantages will be readily apparent to one skilled in the art to which the invention pertains from a perusal of the claims and the following detailed description when read with the appended drawings

THE DRAWINGS

THE DETAILED DESCRIPTION

Figure 1:
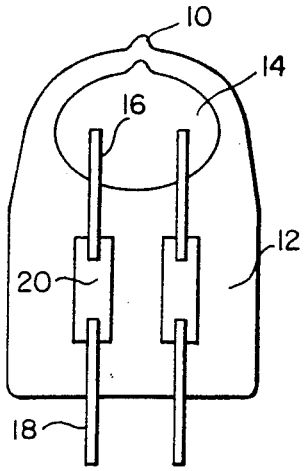
FIG. 1 (PRIOR ART)
FIG. 1 is a side view in elevation of a prior art arc discharge tube showing straight electrodes.

With reference to the figures, single ended arc discharge tubes are generally formed from a tube of fused silica closed at one axial end by an exhaust tip-off 10 and closed at the other axial end by a pinch seal 12 to form the envelope 14 in which the arc occurs.

With continued reference to the figures, the electrodes 16 are conventionally connected to the lead-in wires 18 by ribbons or foils 20.

Figure 2:
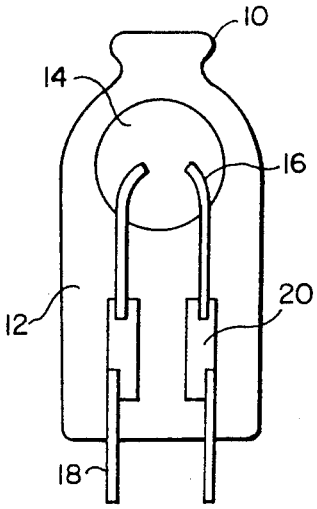
FIG. 2 (PRIOR ART)
FIG. 2 is a side view in elevation of a prior art arc discharge tube with curved electrodes.
Figure 3:
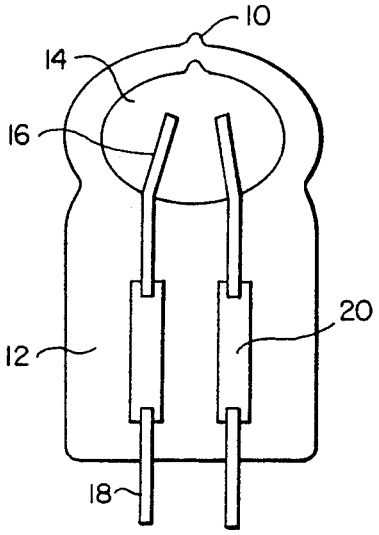
FIG. 3 (PRIOR ART)
FIG. 3 is a side view in elevation of a prior art arc discharge tube with angled electrodes.
Figure 4:
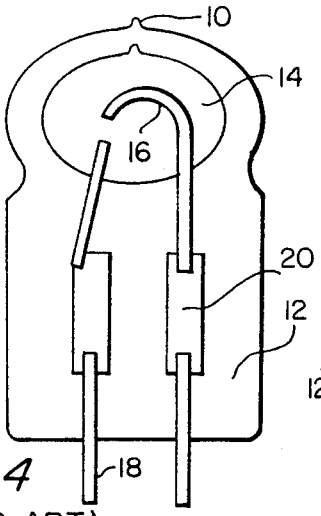
FIG. 4 (PRIOR ART)
FIG. 4 is a side view in elevation of a prior art arc discharge tube with a generally axial arc.
Figure 5:
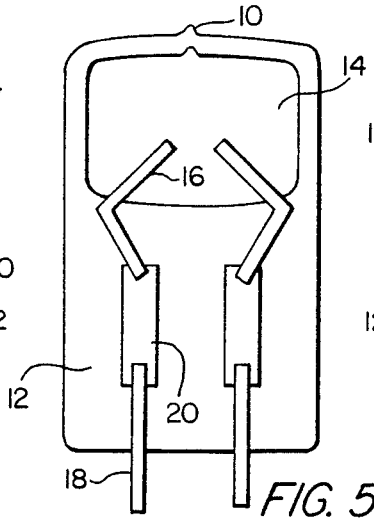
FIG. 5 is a side view in elevation of a first embodiment of the arc tube of the present invention.
Figure 6:
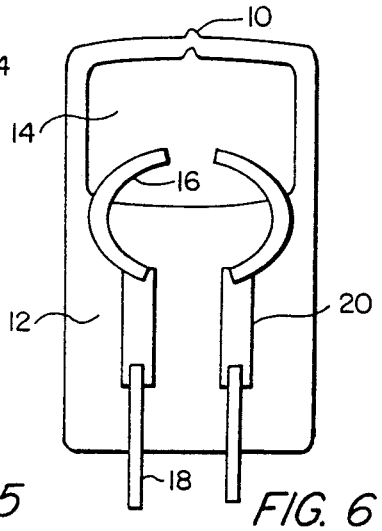
FIG. 6 is a side view in elevation of a second embodiment of an arc tube of the present invention.
Figure 7:
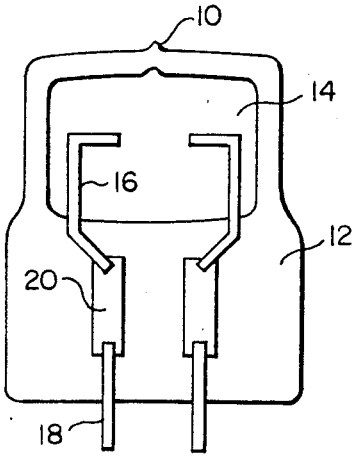
FIG. 7 is a side view in elevation of a third embodiment of an arc tube of the present invention.

In the prior art, the electrodes 16 may be straight as illustrated in FIG. 1, curved as illustrated in FIG. 2, or angled as illustrated in FIG. 3, all for the purpose of centering the arc within the envelope 14 at a spacing less than the spacing of the electrodes elsewhere in the envelope. As shown in FIG. 4, the electrode 16 may be shaped so as to provide a generally axial arc. However, such arcs are generally laterally offset from the center of the envelope 14 because of the limited available space between the electrodes.

As shown in FIGS. 5–8, one or both of the electrodes of the present invention are generally concave towards the other, diverging between the ribbons 20 and the point of egress from the pinch seal 12, so as to provide a greater spacing between the electrodes 16 at the point of egress from the pinch seal than the spacing between the ribbons 20. In the further thereof, at least one of the electrodes may be shaped generally as a square bracket, a parenthesis or an angle bracket.

Figure 8:
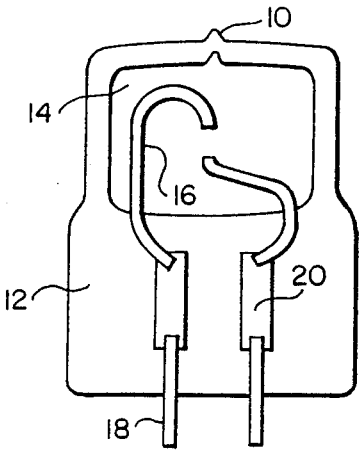
FIG. 8 is a side view in elevation of a fourth embodiment of the arc tube of the present invention with an axial arc.

As shown in FIG. 8, this increased lateral spacing between the electrodes 16 at the point of entry into the envelope 14 permits the centering of the arc within the envelope along the axis thereof. In this embodiment, the separation of the electrodes within the pinch seal permits the electrodes to remain substantially parallel in their central portion and to terminate in a substantially coaxial relationship along the axis of the envelope.

The use of the electrodes of the present invention results in a lamp which may be used in any orientation with a reduced likelihood of obtaining the "Jacobs Ladder" effect. Moreover, such use provides a cleaner, more intense arc as a result of the concentration thereof at the extreme free ends of the electrodes. It permits better optical control with less lamp deterioration and corresponding longer lamp life and does not have the "Jacob's Ladder" problem.

While a preferred embodiment of the present invention has been described, other variations and modifications will naturally occur to those skilled in the art from a perusal hereof. It is therefore to be understood that the embodiments herein are illustrative only, and that the scope of the invention is to be defined solely by the appended claims when accorded a full range of equivalents.

What is claimed is:

1. In a single ended arc discharge tube comprising:

an envelope closed at one end with an exhaust tip-off and closed at the other end with a pinch seal;

a pair of spaced parallel ribbons embedded in said pinch seal;

a pair of spaced lead-in wires electrically connected one each to said ribbons within said pinch seal and extending out of said pinch seal for connection to a source of electrical power; and a pair of electrodes connected one each to said ribbons within said pinch seal and extending out of said pinch seal into said envelope, the improvement wherein said electrodes diverge within said pinch seal commencing at the connection to said ribbons so as to exit said pinch seal spaced apart a distance significantly greater than the distance between said ribbons and greater than the distance therebetween at any point within said envelope.

2. The arc discharge tube of claim 1 wherein at least one of said electrodes is shaped generally as a square bracket.

3. The arc discharge tube of claim 1 wherein at least one of said electrodes is shaped generally as a parenthesis.

4. The arc discharge tube of claim 1 wherein at least one of said electrodes is shaped generally as an angle bracket.

5. The arc discharge tube of claim 1 wherein at least one of said electrodes are angled away from each other within said pinch seal, are substantially parallel to each other over a central portion thereof within said envelope and are essentially coaxial over the end portion thereof along the axis of said envelope.

6. A singled ended arc discharge tube comprising:

an envelope formed by a tube closed at one end with an exhaust tip-off and closed at the other end with a pinch seal;

a pair of spaced parallel ribbons embedded in said pinch seal;

a pair of spaced lead-in wires electrically connected one each to said ribbons within said pinch seal and extending out of said pinch seal for connection to a source of electrical power; and a pair of electrodes connected one each to said ribbons within said pinch seal and extending out of said pinch seal into said envelope.

said electrodes being generally concave toward each other whereby the smallest distance therebetween is at the free ends and is less than the distance between the connections of said electrodes to said ribbons and the greatest distance therebetween is at the entrance to said envelope and is greater than the distance between the connections of said electrodes to said ribbons.

7. The arc discharge tube of claim 6 wherein said electrodes are shaped generally as square brackets.

8. The arc discharge tube of claim 6 wherein said electrodes are shaped generally as angle brackets.

9. The arc discharge tube of claim 6 wherein said electrodes are shaped generally as parenthesis.

10. A singled ended arc discharge tube comprising:

an envelope closed at one axial end with an exhaust tip-off and closed at the other axial end with a pinch seal with a line connecting said axial ends defining a central axis;

a pair of spaced parallel ribbons embedded in said pinch seal;

a pair of spaced lead-in wires electrically connected one each to said ribbons within said pinch seal and extending out of said pinch seal for connection to a source of electrical power; and a pair of electrodes connected one each to said ribbons within said pinch seal and extending out of said pinch seal into said envelope said electrodes being spaced apart a greater distance at said ribbons than at the free ends thereof, being spaced apart a greater distance at the entrance to said envelope than at said ribbons, and terminating with the free ends thereof substantially coaxial with said central axis.

11. A singled ended arc discharge tube comprising:

an envelope closed at one axial end with an exhaust tip-off and closed at the other axial end with a pinch seal;

a pair of spaced parallel ribbons embedded in said pinch seal;

a pair of spaced lead-in wires electrically connected one each to said ribbons within said pinch seal and extending out of said pinch seal for connection to a source of electrical power; and a pair of electrodes connected one each to said ribbons within said pinch seal and extending out of said pinch seal into said envelope the free ends of said electrodes being substantially aligned along a line generally parallel to said ribbons spaced approximately midway between said ribbons.

* * * * *